US011744381B2

(12) United States Patent
Chavez

(10) Patent No.: US 11,744,381 B2
(45) Date of Patent: Sep. 5, 2023

(54) PILLOW DIVIDER DEVICE

(71) Applicant: Chris Chavez, Simi Valley, CA (US)

(72) Inventor: Chris Chavez, Simi Valley, CA (US)

( * ) Notice: Subject to any disclaimer, the term of this patent is extended or adjusted under 35 U.S.C. 154(b) by 0 days.

(21) Appl. No.: 17/578,636

(22) Filed: Jan. 19, 2022

(65) Prior Publication Data

US 2022/0232989 A1 Jul. 28, 2022

Related U.S. Application Data

(60) Provisional application No. 63/142,202, filed on Jan. 27, 2021.

(51) Int. Cl.
*A47C 21/00* (2006.01)

(52) U.S. Cl.
CPC ..... *A47C 21/00* (2013.01)

(58) Field of Classification Search
None
See application file for complete search history.

(56) References Cited

U.S. PATENT DOCUMENTS 2,208,713 A * 7/1940 Wilhelm ..... A47G 9/00 5/513
2,563,570 A * 8/1951 Williams ..... A47C 21/00 211/184
2014/0310877 A1* 10/2014 Sternlight ..... A47G 9/02 5/639
2017/0251883 A1* 9/2017 Johnson ..... A47K 3/125
2019/0231091 A1* 8/2019 Ross ..... A47C 20/025

* cited by examiner

*Primary Examiner* — Robert G Santos
*Assistant Examiner* — Adam C Ortiz
(74) *Attorney, Agent, or Firm* — Brennan, Manna & Diamond, LLC

(57) ABSTRACT

The present invention relates to a pillow divider device primarily comprised of a body that is further comprised of at least one base, at least one vertical wall member and at least one cover. In the preferred embodiment, the base is triangular in shape and the vertical wall member is rectangular in shape. The vertical wall member may be inseparably or removably attached to the top surface of the base. The base and vertical wall member are further enclosed by an outer surface. The base may also have at least one weight or can be filled with water such that it becomes stable and difficult to move. The device can be placed between two partners who are sleeping, wherein the shape of the base and vertical wall member prevent any air exhaled by one partner from contacting the other partner.

7 Claims, 3 Drawing Sheets

PILLOW DIVIDER DEVICE

CROSS-REFERENCE TO RELATED APPLICATION

The present application claims priority to, and the benefit of, U.S. Provisional Application No. 63/142,202, which was filed on Jan. 27, 2021, and is incorporated herein by reference in its entirety.

FIELD OF THE INVENTION

The present invention relates generally to the field of sleeping accessories. More specifically, the present invention relates to a pillow divider device primarily comprised of a body that is further comprised of at least one base, at least one vertical wall member and at least one cover. In the preferred embodiment, the base is triangular in shape and the vertical wall member is rectangular in shape. The vertical wall member may be inseparably or removably attached to the top surface of the base. The base and vertical wall member are further enclosed by an outer surface. The base may also have at least one weight or can be filled with water such that it becomes stable and difficult to move. The device can be placed between two partners who are sleeping, wherein the shape of the base and vertical wall member prevent any air exhaled by one partner from contacting the other partner. Accordingly, the present disclosure makes specific reference thereto. Nonetheless, it is to be appreciated that aspects of the present invention are also equally applicable to other like applications, devices and methods of manufacture.

BACKGROUND

Most partners in a relationship sleep in the same bed. When one partner or both partners must wear a CPAP machine due to sleep apnea, residual exhaust air from the CPAP face mask may contact the other sleeping partner during sleep and disturb said partner. This excess air can be such a disturbance that the other partner cannot sleep as he or she may be continuously woken up by the air hitting the face and/or body. In order to prevent exhaust air from a CPAP from contacting him or her, the partner that does not wear the CPAP mask may attempt to place pillows between him or herself and the partner who does wear the CPAP mask to block any exhaust air from the mask. However, this is a less-than-desirable solution, as pillows take up a significant amount of space on a bed, and also must be constantly adjusted as they move out of position easily.

Therefore, there exists a long-felt need in the art for a device that can be used to prevent exhaust air from a CPAP mask of one partner from contacting another partner when both partners are in bed. There also exists a long-felt need in the art for a pillow divider device that prevents exhaust air from a CPAP mask of one partner from contacting another partner when both partners are in bed, wherein the device does not take up a significant amount of space on a bed. Further, there exists a long-felt need in the art for a pillow divider device that prevents exhaust air from a CPAP mask of one partner from contacting another partner when both partners are in bed, wherein the device does not need to be constantly adjusted and does not move out of position easily.

The subject matter disclosed and claimed herein, in one embodiment thereof, comprises a pillow divider device. The device is primarily comprised of a body that is further comprised of at least one base, at least one vertical wall member and at least one cover. In the preferred embodiment, the base is triangular in shape and the vertical wall member is rectangular in shape. The vertical wall member may be inseparably or removably attached to the top surface of the base. The base and vertical wall member are further enclosed by an outer surface. The base may also have at least one weight or can be filled with a weighted material such that it becomes stable and difficult to move. During use, the device can be placed between two partners who are sleeping wherein the shape of the base and vertical wall member prevent any air exhaled by one partner from contacting the other partner.

In this manner, the pillow divider device of the present invention accomplishes all of the forgoing objectives and provides a device that can be used to prevent exhaust air from a CPAP mask of one partner from contacting another partner when both partners are in bed. Further, the device does not take up a significant amount of space on a bed, does not need to be constantly adjusted and does not move out of position easily. As a result, the pillow divider device overcomes the limitations of existing methods of blocking exhaust air from a CPAP mask from hitting a partner that is not wearing the mask while both partners are in bed.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a pillow divider device. The device is primarily comprised of a body that is further comprised of at least one base, at least one vertical wall member and at least one cover. In various embodiments of the device, the base and vertical wall member may be any shape and size known in the art. However, in the preferred embodiment the base is generally triangular in shape and the vertical wall member is rectangular in shape. The base is comprised of a flat top surface, a flat bottom surface, an angled front surface, an angled rear surface and a pair of generally parallel side surfaces. The vertical wall member is comprised of a front surface and generally parallel rear surface, a pair of side surfaces, a top surface and a bottom surface that rests on the top surface of the base. In one embodiment, the base and vertical wall member may be one continuous piece. However, in another embodiment the top surface of the base and the bottom surface of the vertical wall member is further comprised of at least one fastener that allows the bottom surface to removably attach to the top surface. The base and vertical member may also be manufactured from any material known in the art, but are both preferably manufactured from a padded, foam material that is rigid.

The body is further comprised of a cover that encloses the base and vertical wall member. In differing embodiments, the cover may be manufactured from any fabric material known in the art that is further preferably waterproof and may also have an anti-bacterial coating. The cover may also have at least one fastener that secures the cover around the base and vertical wall member. The cover may also be any color and comprised of a plurality of indicia.

In one embodiment of the device, the base may have at least one weight within the base. The weight provides stability to the base such that it cannot topple over or be moved easily during use. In an alternative embodiment, the base is hollow and has an interior cavity that can be filled with a weighted material via a valve. In this manner, a base can be filled with the desired amount of weighted material to add weight to the base and ensure it cannot topple over or be moved easily during use.

When in use, the device is preferably positioned between a first partner and a second partner, wherein one or both partners may also be wearing a CPAP mask. In this manner, the base and vertical wall deflects any air exhaled from the mask worn by (for example) a second partner from contacting the first partner. Instead, the air is directed over the first partner.

Accordingly, the pillow divider device of the present invention is particularly advantageous as it provides a device that can be used to prevent exhaust air from a CPAP mask of one partner from contacting another partner when both partners are in bed. While doing so, the device also does not take up a significant amount of space on a bed, does not need to be constantly adjusted and does not move out of position easily. In this manner, the pillow divider device overcomes the limitations of existing methods of blocking exhaust air from a CPAP mask from hitting a partner that is not wearing the mask while in bed.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
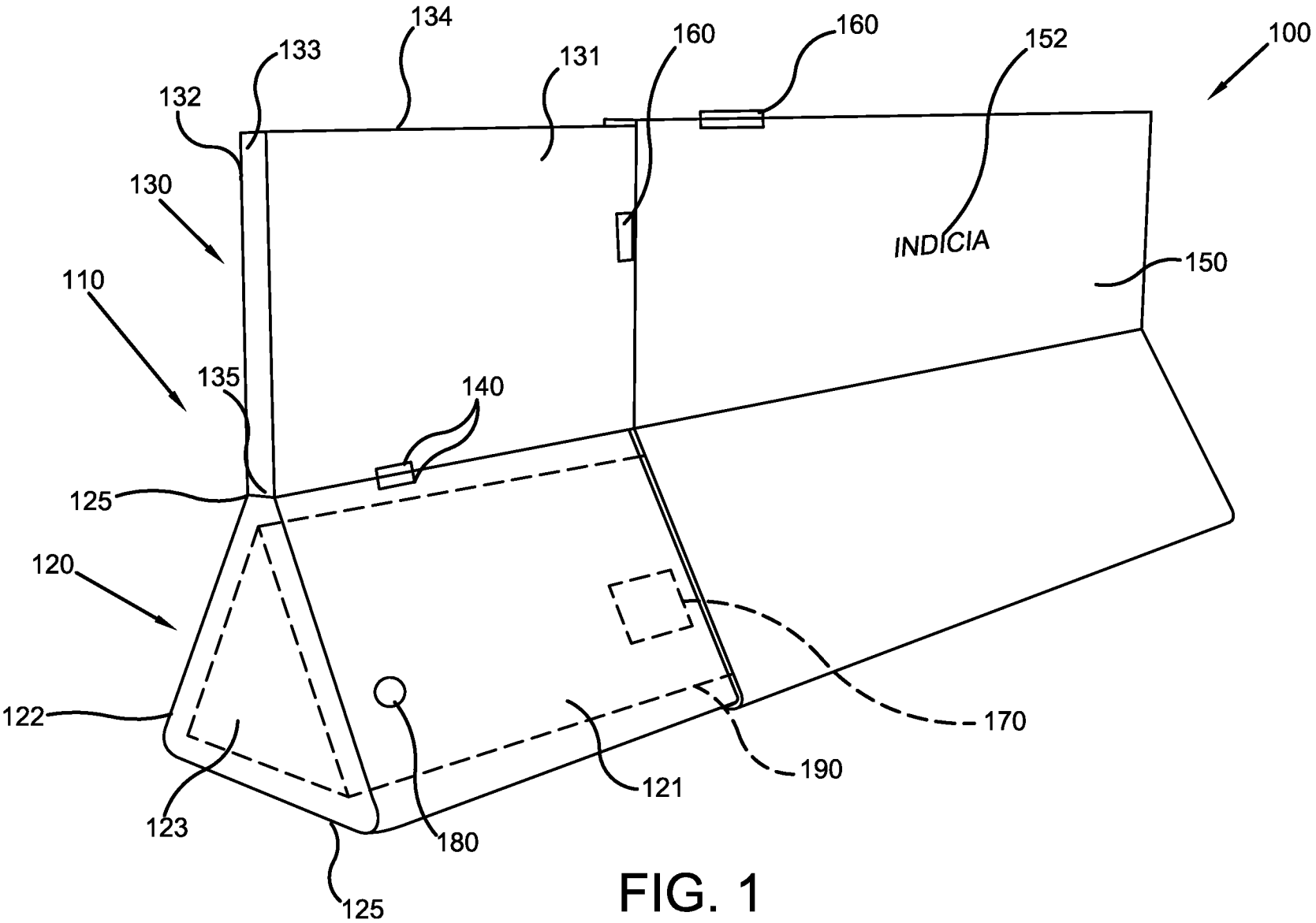
FIG. 1 illustrates a perspective, partially cross-sectional view of one potential embodiment of a pillow divider device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device that can be used to prevent exhaust air from a CPAP mask of one partner from contacting another partner when both partners are in bed. There also exists a long-felt need in the art for a pillow divider device that prevents exhaust air from a CPAP mask of one partner from contacting another partner when both partners are in bed, wherein the device does not take up a significant amount of space on a bed. Further, there exists a long-felt need in the art for a pillow divider device that prevents exhaust air from a CPAP mask of one partner from contacting another partner when both partners are in bed, wherein the device does not need to be constantly adjusted and does not move out of position easily.

The present invention, in one exemplary embodiment, is comprised of a pillow divider device. The device is primarily comprised of a body that is further comprised of at least one base, at least one vertical wall member and at least one cover. In various embodiments of the device, the base and vertical wall member may be any shape and size known in the art. However, in the preferred embodiment the base is generally triangular in shape and the vertical wall member is rectangular in shape. The base is comprised of a flat top surface, a flat bottom surface, an angled front surface, an angled rear surface and a pair of generally parallel side surfaces. The vertical wall member is comprised of a front surface and generally parallel rear surface, a pair of side surfaces, a top surface, and a bottom surface that rests on the top surface of the base. The base and vertical wall member may be one continuous piece or two separable pieces such that the top surface of the base and the bottom surface of the vertical wall member is further comprised of at least one fastener that allows the bottom surface to removably attach to the top surface. The base and vertical member may also be manufactured from any material known in the art, but are both preferably manufactured from a padded, foam material that is rigid.

The body is further comprised of a cover that encloses the base and vertical wall member. The cover may be manufactured from any fabric material known in the art that is further preferably waterproof and may also have an anti-bacterial coating. The cover may also have at least one fastener that secures the cover around the base and vertical wall member. The cover may also be any color and comprised of a plurality of indicia.

In one embodiment of the device, the base may have at least one weight within the base. The weight provides stability to the base such that it cannot topple over or be moved easily during use. In an alternative embodiment, the base is hollow and has an interior cavity that can be filled with weighted material via a valve. In this manner, a base can be filled with the desired amount of material to add weight to the base and ensure it cannot topple over or be moved easily during use.

When in use, the device is preferably positioned between a first partner and a second partner, wherein one or both partners may wear a CPAP mask. In this manner, the base and vertical wall deflects any air exhaled from the mask worn by (for example) a second partner from contacting the first partner. Instead, the air is directed over the first partner.

Accordingly, the pillow divider device of the present invention is particularly advantageous as it provides a device that can be used to prevent exhaust air from a CPAP mask of one partner from contacting another partner when both partners are in bed. While doing so, the device also does not take up a significant amount of space on a bed and does not need to be constantly adjusted and does not move out of position easily. In this manner, the pillow divider device overcomes the limitations of existing methods of blocking exhaust air from a CPAP mask from hitting a partner that is not wearing the mask while in bed that are known in the art.

Referring initially to the drawings, FIG. 1 illustrates a perspective, partially cross-sectional view of one potential embodiment of a pillow divider device 100 of the present invention in accordance with the disclosed architecture. The device 100 is primarily comprised of a body 110 that is further comprised of at least one base 120, at least one vertical wall member 130, and an outer surface 150. In various embodiments of the device 100, the base 120 and vertical wall member 130 may be any shape and size known in the art. However, in the preferred embodiment the base 120 is generally triangular in shape and has a flat top surface 124, a flat bottom surface 125, an angled front surface 121, an angled rear surface 122 and a pair of generally parallel side surfaces 123. The vertical wall member 130 is preferably rectangular in shape and is comprised of a front surface 131 and generally parallel rear surface 132, a pair of side surfaces 133, a top surface 134, and a bottom surface 135 that rests on the top surface 124 of the base 120.

In one embodiment, the base 120 and vertical wall member 130 may be inseparable such that the body 110 is one continuous piece. However, in another embodiment the top surface 124 of the base 120 and the bottom surface 135 of the vertical wall member 130 are further comprised of at least one fastener 140 that allows the bottom surface 135 to removably attach to the top surface 124. In differing embodiments, the fastener 140 may be any fastener known in the art such as, but not limited to, a hook and loop fastener, adhesive, zipper, magnet, snap-button, ties, etc. The base 120 and vertical member 130 may also be manufactured from any pillow material known in the art, but are both preferably manufactured from a padded, foam material that is rigid.

The body 110 is further comprised of an outer surface 150 that encloses the base 120 and vertical wall member 130. In differing embodiments, the outer surface 150 may be manufactured from any fabric material known in the art such as, but not limited to, a vinyl, leather, canvas, cashmere, chenille, chiffon, cotton, damask, jersey, lace, linen, wool, modal, polyester, satin, silk, spandex, suede, tweed, twill, velvet, acrylic, modacrylic, nylon, polypropylene, polyurethane, polyvinyl chloride, polyethylene, vinylidene, benzoate, aramid, rayon, acetate, triacetate, etc. Said material is further preferably waterproof and may also have an antibacterial coating. The cover 150 may also have at least one fastener 160 that secures the cover 150 around the base 120 and vertical wall member 130. The fastener 140 may be any fastener known in the art such as, but not limited to, a hook and loop fastener, adhesive, zipper, magnet, snap-button, ties, etc. The cover 150 may also be any color and comprised of a plurality of indicia 152 such as, but not limited to, patterns, logos, emblems, images, symbols, designs, letters, numbers, words, characters, animals, advertisements, brands, etc.

In one embodiment of the device 100, the base 120 may have at least one weight 170 within the base 120. The weight 170 provides stability to the base 120 such that it cannot topple over or be moved easily during use. In various embodiments, the weight 170 may be any amount of weight and may also be removable or non-removable. In an alternative embodiment, the base 120 is hollow and has an interior cavity 190 that can be filled with weighted material via a valve 180. In this manner, a base 120 can be filled with the desired amount of weighted material add weight to the base 120 and ensure it cannot topple over or be moved easily during use. In the preferred embodiment, the weighted material is weighted beads or similar substance of the like.

Figure 2:
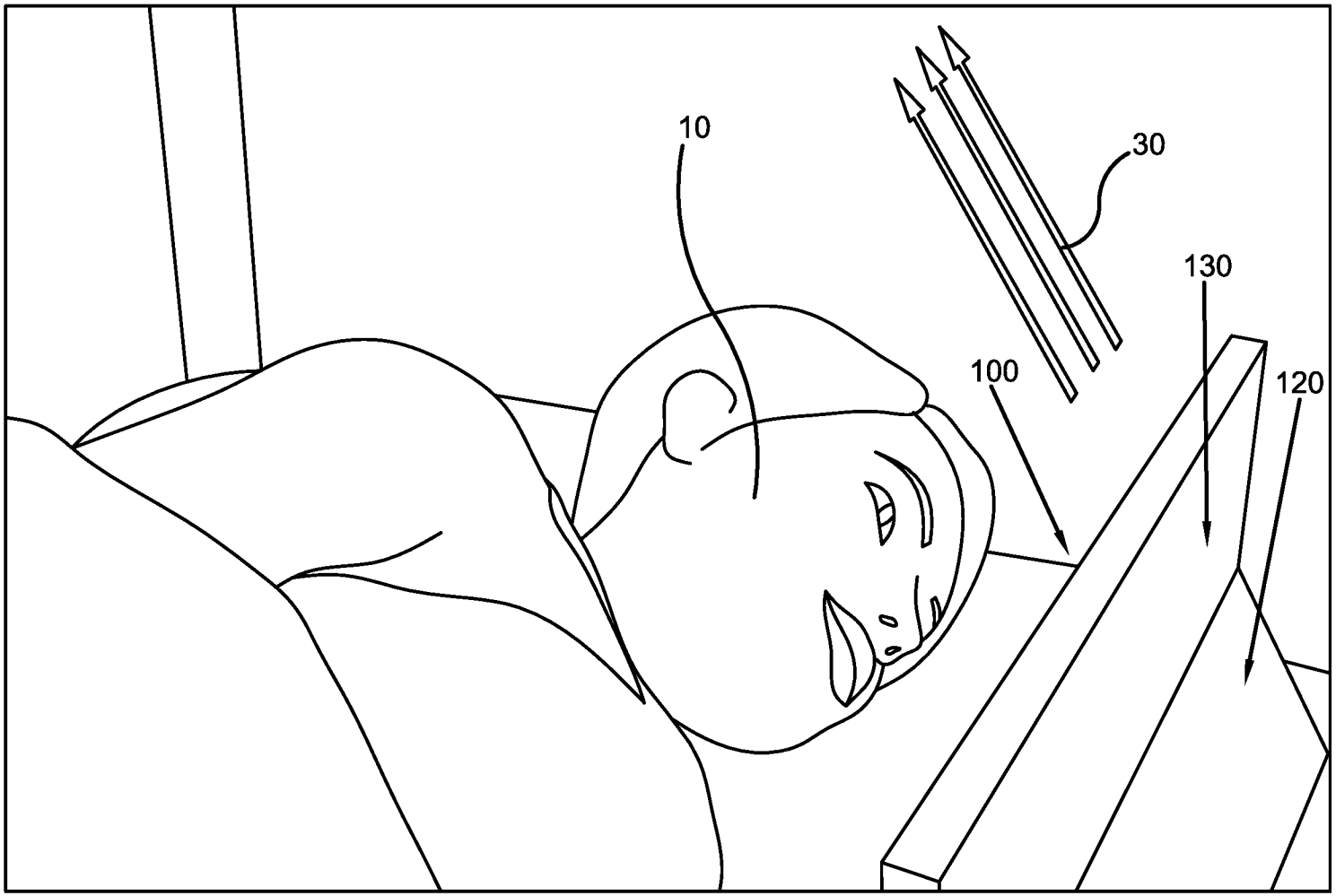
FIG. 2 illustrates a perspective view of one potential embodiment of a pillow divider device of the present invention in accordance with the disclosed architecture.
Figure 3:
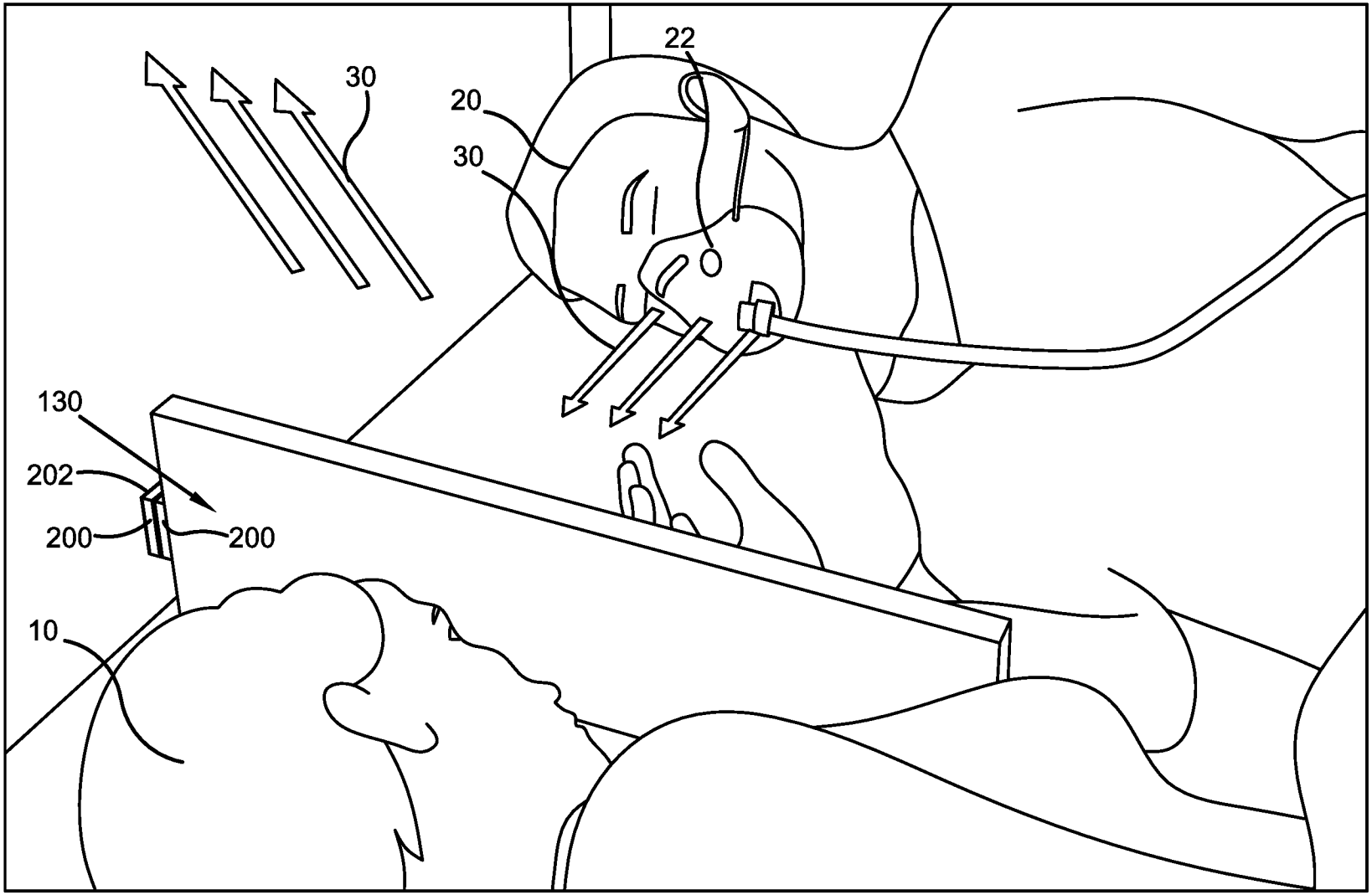
FIG. 3 illustrates a perspective view of one potential embodiment of a pillow divider device of the present invention in accordance with the disclosed architecture.

FIG. 2 and FIG. 3 illustrate perspective views of one potential embodiment of a pillow divider device 100 of the present invention in accordance with the disclosed architecture. When in use, the device 100 is preferably positioned between a first partner 10 and a second partner 20, wherein one or both partners 10, 20 may wear a CPAP mask 22. In this manner, the base 120 and vertical wall 130 deflect an air 30 exhaled from the mask 22 worn by (for example) a second partner 20 from contacting the first partner 10. Instead, the air 30 is directed over the first partner 10. Therefore, the first partner 10 is not disturbed by the air 30.

In order to further secure the device 100 during use, one side surface 123, 133 of the device 100 may further be comprised of at least one fastener 200. The fastener 200 may be any fastener known in the art, but is preferably a hook fastener. The fastener 200 may further be fixedly or removably attached to the side surface 123, 133. The device 100 is also comprised of at least one additional fastener 200 that may be any fastener known in the art, but is preferably a loop fastener. Said fastener 200 further has an adhesive bottom surface 202 such that the fastener 200 can be removably secured to a headboard 40. In this manner, the fastener 200 of the side surface 123, 133 can be secured to the fastener 200 of the headboard 40 to secure the device 100 to the headboard 40 and further prevent any movement of the device 100.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "pillow divider device" and "device" are interchangeable and refer to the pillow divider device 100 of the present invention.

Notwithstanding the forgoing, the pillow divider device 100 of the present invention and its various components can be of any suitable size and configuration as is known in the art without affecting the overall concept of the invention, provided that they accomplish the above-stated objectives. One of ordinary skill in the art will appreciate that the size, configuration and material of the pillow divider device 100 as shown in the FIGS. are for illustrative purposes only, and that many other sizes and shapes of the pillow divider device 100 are well within the scope of the present disclosure. Although the dimensions of the pillow divider device 100 are important design parameters for user convenience, the pillow divider device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pillow divider device comprising:

a base comprising an exterior surface and an interior cavity, wherein the base comprises a generally triangular cross-section;

a wall extending outwardly from a top surface of the base and comprising a generally rectangular cross-section;

a fastener; and a cover, wherein the cover is sized and configured to removably encompass both the base and the wall, and further wherein the base further comprises a valve positioned along the exterior surface and in fluid communication with the interior cavity.

2. The pillow divider device of claim 1, wherein the cover is comprised of a waterproof material.

3. The pillow divider device of claim 1 further comprising a weighted substance positioned within the interior cavity.

4. The pillow divider device of claim 3, wherein the weighted substance is a water or a sand.

5. The pillow divider device of claim 4, wherein the fastener removably attaches the base to the wall.

6. The pillow divider device of claim 5, wherein the cover further comprises an indicia.

7. The pillow divider device of claim 6, wherein the fastener is a select one of a hook and loop fastener, an adhesive, a zipper, a magnet, a snap-button and a tie.

* * * * *